United States Patent [19]

Eitel et al.

[11] 3,943,746

[45] Mar. 16, 1976

[54] AUTOMATIC ALIGNING PROCESS AND ALIGNING PRESS HAVING A SINGLE ALIGNING STATION

[75] Inventors: Hans-Georg Eitel, Ettlingen; Waldemar Morlock, Karlsruhe-Rintheim; Dieter Ruf, Karlsruhe, all of Germany

[73] Assignee: Eitel KG., Werkzeugmaschinenfabrik, Karlsruhe, Germany

[22] Filed: Sept. 17, 1974

[21] Appl. No.: 506,729

[30] Foreign Application Priority Data

Sept. 17, 1973 Germany ..... 2346797

[52] U.S. Cl. ..... 72/384; 72/7; 72/12; 72/389; 72/702

[51] Int. Cl.[2] ..... B21D 17/02

[58] Field of Search ..... 72/10, 11, 12, 7, 380, 72/389, 702, 30, 384; 29/6

[56] References Cited

UNITED STATES PATENTS

| | | | |
|---|---|---|---|
| 3,459,018 | 8/1969 | Miller | 72/14 |
| 3,481,170 | 12/1969 | Galdabini | 72/11 |
| 3,713,312 | 1/1973 | Galdabini | 72/389 |

FOREIGN PATENTS OR APPLICATIONS

| | | |
|---|---|---|
| 1,061,156 | 7/1959 | Germany |
| 1,169,256 | 4/1964 | Germany |

*Primary Examiner*—Milton S. Mehr
*Assistant Examiner*—James R. Duzan
*Attorney, Agent, or Firm*—Finnegan, Henderson, Farabow & Garrett

[57] ABSTRACT

Method and apparatus for automatically straightening elongated and at least partly rotationally symmetrical workpieces by applying a sequence of straightening strokes to a workpiece at one straightening station to counteract a deformation until the measured instantaneous values of the deformation fall within a predetermined deformation tolerance. The depth of the straightening strokes is determined by the difference between the measured instantaneous values of the deformation and the mean of the maximum and minimum values of the deformation.

12 Claims, 4 Drawing Figures

AUTOMATIC ALIGNING PROCESS AND ALIGNING PRESS HAVING A SINGLE ALIGNING STATION

Figure 1:
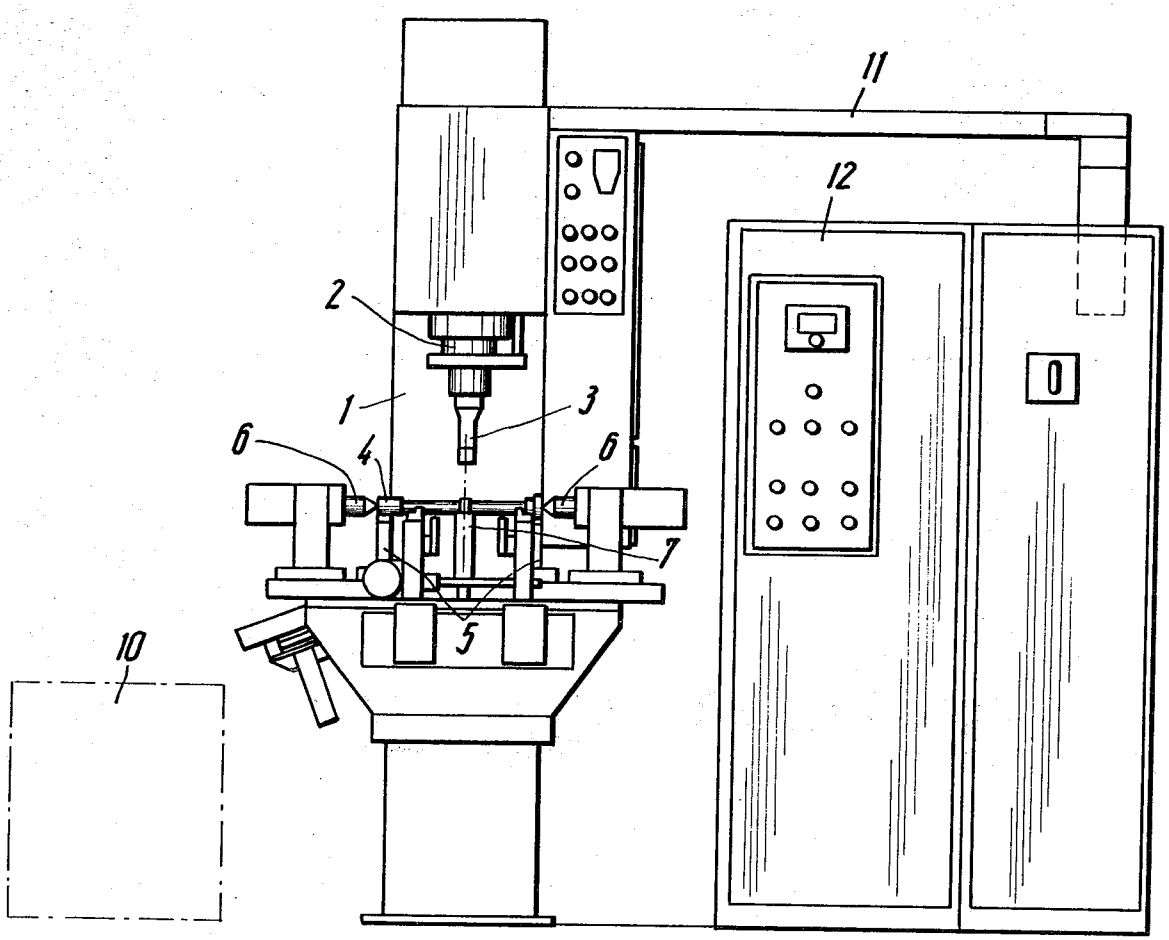

The invention relates to a process for the automatic straightening or alignment of elongated, and at least partly rotationally symmetrical workpieces, wherein a sequence of straightening strokes is applied to the workpiece in an aligning or straightening station, in a direction opposite to its original bending or deformation, after the deformation of the workpiece has been detected. The depth of the straightening stroke is varied in dependence on the measured instantaneous value of the deformation until the value falls below a predetermined or deformation alignment tolerance. The invention also relates to an automatic aligning or straightening machine having one straightening station, for carrying out the aforesaid process.

The straightening of elongated and at least partly rotationally symmetrical workpieces, such as shafts, for example, axle shafts, gearshafts, camshafts, crankshafts, or the like, and also bolts, axles, spindles, tubes, or the like, which as the result of heat treatment or of machining or non-cutting processing undergo deformation (i.e. in particular a deviation from the strictly straight shape transverse to the central axis of the workpiece), has hitherto been effected mainly in hand-operated aligning presses. Such a press is shown in German Patent Specification No. 1,169,256.

A method of aligning or straightening elongated workpieces is disclosed by German Specification No. 1,627,511, in which at a single straightening station a sequence of shaping operations is applied to the workpiece to counteract its original deformation or sag. The workpiece is subjected to a first working stroke which deforms the workpiece beyond the completely straight shape, the excess deformation corresponding approximately to the elastic deflection $Fp$ which can be applied to the workpiece without any part thereof exceeding the elastic limit and passing into the plastic range. After this step, the deforming force is removed and the remaining eccentricity E1 is measured. A second working stroke follows for the purpose of effecting, beyond the completely straight position, a deflection which is equal to $Fp + E1$, whereupon once again the deforming force is removed and the eccentricity E2 now remaining is measured. Further working strokes are performed in order to bring about a deflection $Fp + E1 + E2$ etc., until the remaining deviation En is below a determined value. According to an alternative this process can be simplified, with some sacrifice of accuracy, by assuming a constant average value for E1, E2, and E3.

For the method described above there is also shown a straightening press having one straightening station (in the same German Specification 1,627,511. The press has a press piston with an adjustable working stroke, supporting devices for the workpiece and at least one device for measuring or recording the deformation or deflection of the workpiece. A control device is provided which in a first deforming operation brings about a deformation or deflection of the workpiece undergoing straightening, this deformation or deflection exceeding the zero deflection position by the extent of the elastic deflection. The control device also ensures that in the subsequent deformation or working operations a deflection occurs which in every case is equal to deviation from the zero line which still exists at the end of the preceding operation, plus the elastic deviation. For this purpose there is also provided an electronic programming device to which the value of the elastic deviation and that of the deviation permissible at the end of the straightening operation can be fed, together with signal connections between the programming device, the device for measuring or recording the deflection, and the electrohydraulic power device for the straightening press, the control device producing a control or operating signal for the deformation or working operation which is to be carried out by the straightening press on each occasion. The measuring device is mounted rigidly on the table of the straightening press as can be seen in the drawing of German Specification No. 1,627,511. In a practical construction of this straightening press (see G.B. publication "Machinery and Production Engineering," May 10, 1972, page 18) an aligning carriage travels in the axial direction of the workpiece to a loading and unloading station, for the purpose of changing the workpiece. This carriage must also move from one straightening station to another.

Automation of the straightening process described cannot be achieved satisfactorily.

1. The value of the elastic deflection or deformation which is to be fed to the programming device must in fact be determined empirically. This gives rise to difficulties, since this elastic deflection depends on the material of the workpiece, on the resistance and moment of inertia of the workpiece at the respective straightening station, and on the distance between supports holding the workpiece during the straightening operation.

The need for the operator of the press to determine the value of the elastic deflection is particularly disadvantageous when the straightening press must be frequently reset for different workpieces. However, even for a large number of identical workpieces at the same straightening station the elastic deflection is not constant, but varies because of variations in the material, in the heat treatment, or in other preparatory treatment.

2. In order to avoid overbending, that is, excessive deflection to a bend of the workpiece with the opposite sign, in the first working stroke of the straightening press, the value of the elastic deflection which is to be fed to the programming device must be kept so low that overbending will not occur even in the most unfavorable case. This in turn, however, is disadvantageous in the series production of workpieces because the number of working strokes and consequently the straightening time must be increased.

3. A large number of working strokes are necessary, since even in the final phase of the straightening operation the increases of stroke depth become increasingly small.

4. Since the measuring device is mounted rigidly on the table of the straightening press, thermal or mechanical variations or wear of the workpiece support, of the press table, and/or of the straightening punch impair the accuracy of the straightening operation, that is to say the operator must often readjust the measuring device.

5. Because the workpiece is advanced and removed axially, relatively long pauses occur between the straightening of successive workpieces, which is particularly detrimental in series production (for example in motor vehicle construction).

Recently the inventor of the straightening press described above and shown in German Specification No.

1,627,511, disclosed another straightening press construction based on the same working principle (see U.S. Pat. No. 3,713,312) in which a first sequence of working strokes of increasing depth are separated by a constant increase, whereupon a second series of working strokes, likewise of increasing depth, have a constant increase which is smaller than in the first series. This construction was intended to simplify the control of the press.

However, this straightening press construction continues to have the same disadvantages 1 to 5 set forth above.

The primary objects of this invention therefore consist in providing an automatic straightening process and an automatic straightening press having one straightening station for the performance of the said process, which are very largely automated, that is, work without elastic deflection which has to be determined empirically, and which, particularly through the elimination of the determination of the elastic deflection, also have a shorter straightening time per workpiece, while the accuracy of the straightening press is independent of mechanical and thermal variations in the elements applying the straightening force or stroke and in the straightening supports, and requires no readjustment.

According to the invention, the following process steps are carried out: for the detection of the deformation, the workpiece performs a full revolution, the maximum and minimum values of the deformation thereby determined are stored and the mean value is formed from them; thereupon the workpiece is further turned and the deformation values now occurring are compared with the mean value in order to detect a change of sign of the difference between the mean value and the instantaneous values of the deformation; after detection of the change of sign the workpiece is further turned until any bend of the workpiece points towards the straightening force, and then the instantaneous value of the deformation is compared with the mean value in such a manner that in the event of the aligning or deformation tolerance being exceeded, the first straightening stroke is triggered with a depth of stroke such that the element applying the straightening force or stroke comes close to or engages the workpiece; after the first straightening stroke has been made the instantaneous value of the deformation is measured again and compared with the mean value in such a manner that if the deformation tolerance is exceeded again, a second straightening stroke is made whose depth is increased in relation to the first straightening stroke by the amount of the last difference measured between the instantaneous value and the mean value of the deformation; and straightening strokes then follow with correspondingly adjusted depth of stroke until the deviation between the instantaneous value and the mean value lies within the deformation tolerance.

The straightening method of the invention thus does not require the determination of any elastic deflection, and the performance of the straightening process requires no special knowledge of empirical calculations.

In this process it is advantageous that if a negative sign for the difference between the mean value and the instantaneous value of the deformation is detected at the same time as the deformation tolerance is exceeded, the workpiece is turned with its curvature in the direction of the straightening force and the depth of stroke undergoes an adjustable first decrease substantially equal to the deformation tolerance.

According to the invention therefore, and in contrast to the known process, overbending is basically harmless to the straightening process.

In addition, it is preferable for the depth of stroke of the first straightening stroke to be substantially equal to the distance between the element applying the straightening force or stroke, when in its starting position, and the central axis of the workpiece, minus the radius of the latter.

In a further development of the invention, starting from the second or a later straightening stroke, the depth of stroke may additionally be subjected to an adjustable minimum increase substantially equal to the deformation tolerance.

The provision of a minimum increase provides the advantage that the variation of the depth of stroke at the end of the straightening operation, that is, for the last straightening strokes, is not too small, since otherwise the number of straightening strokes and hence the time required for the straightening operation would become relatively great.

In another development of the invention the rotational speed of the workpiece may be adjustable for the purpose of determining the deformation. In this way a rotational speed corresponding to the moment of inertia of the workpiece can be adjusted.

If the workpieces to be straightened in succession are identical, it is preferable for the depth of stroke of the first straightening stroke for any workpiece to be made equal to the depth of stroke of the last straightening stroke performed for the immediately preceding straightened workpiece.

In this way an extraordinary shortening of the straightening time is achieved, since it can be assumed that the deformation for identical workpieces is approximately equal, so that even the first straightening stroke for the second and subsequent workpieces largely eliminates the deformation. Furthermore, mechanical and thermal variations of the elements applying the straightening force or stroke, of the machine column, of the straightening supports, and so on, no longer constitute sources of error, because the preceding workpiece determines the depth of stroke and a variation of these parameters since the straightening of the preceding workpiece is obviously extremely small.

In this way any gradual variations in dimensions which may occur in the diameter of various workpieces of a series are also automatically compensated, so that the straightening time is not lengthened nor is the accuracy of straightening impaired through variations in diameter.

The automatic straightening method therefore goes through a self-adjusting or control process.

It is obvious that this further development of the invention is of very great advantage, particularly in the production of a series of workpieces. Thus the straightening process of the invention is particularly suitable for automatic aligning or straightening presses used in automatic production lines or automated transfer lines.

However, it may also be advisable in series production for the depth of stroke of the first straightening stroke for the workpiece to undergo a second adjustable decrease, which is substantially equal to the sum of the deformation tolerance and the diameter tolerance of the workpiece.

This provides the further advantage of avoiding the overbending to the workpiece through the first straightening stroke.

Since in the straightening operation it is not possible to prevent entirely an increase of the deformation in another radial direction of the workpiece, it is advisable to turn the workpiece another complete revolution after it has been found that the deviation between the instantaneous value of the deformation and the mean value lies within the deformation tolerance, in order to verify whether the difference between the mean value and each instantaneous value of the deformation lies within the deformation tolerance.

In addition, after a predetermined straightening time or a predetermined deformation has been exceeded it is advisable for the respective workpiece to be sorted out or marked.

In this way a determined cycle time can be maintained when the workpiece is processed in an automatic production line, so that optimum use is made of the latter and idling of the other machine tools in the production line can be prevented.

In order to reduce the idle machine times during straightening, particularly when the process is applied to an automatic production line, it is advisable for the workpiece to be supplied and removed transversely to its axial direction.

The automatic aligning press has one straightening station for carrying out the method of the invention and is characterised in that workpiece holders are provided to clamp the workpiece which are adapted to be raised to a measuring position against a fixed stop, for the purpose of measuring the deformation, the workpiece holders being rotatable by a motor, and adapted, together with the workpiece, to be lowered onto the straightening supports before or on the triggering of the next straightening stroke.

This arrangement provides the advantage that, through the positioning of the workpiece holders against the fixed stop, the workpiece is always raised into the same measuring position in order to be able to make comparative measurements after the straightening strokes. This avoids the need to turn the workpiece for the formation of the mean value after each straightening stroke with a view to checking the result of the straightening operation.

Figure 2:
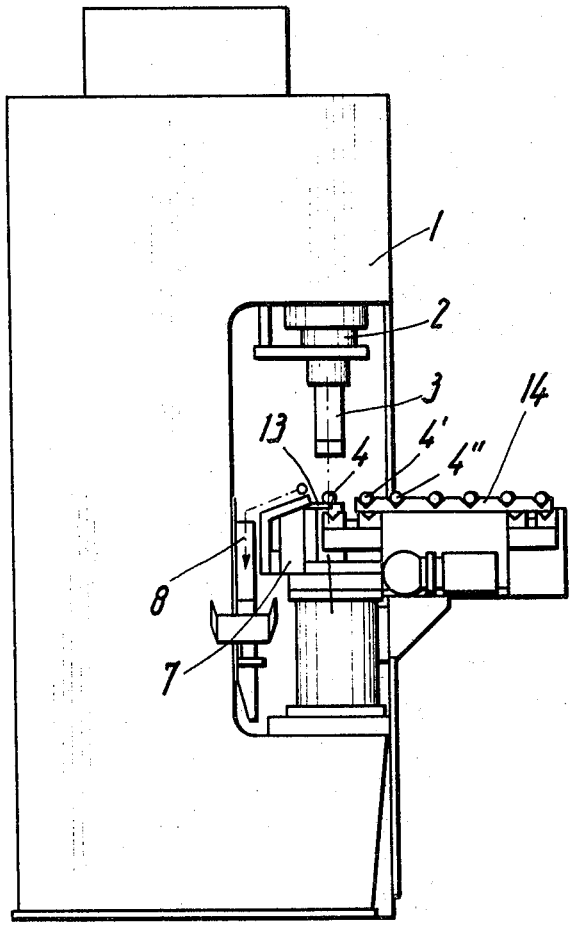
Figure 3:
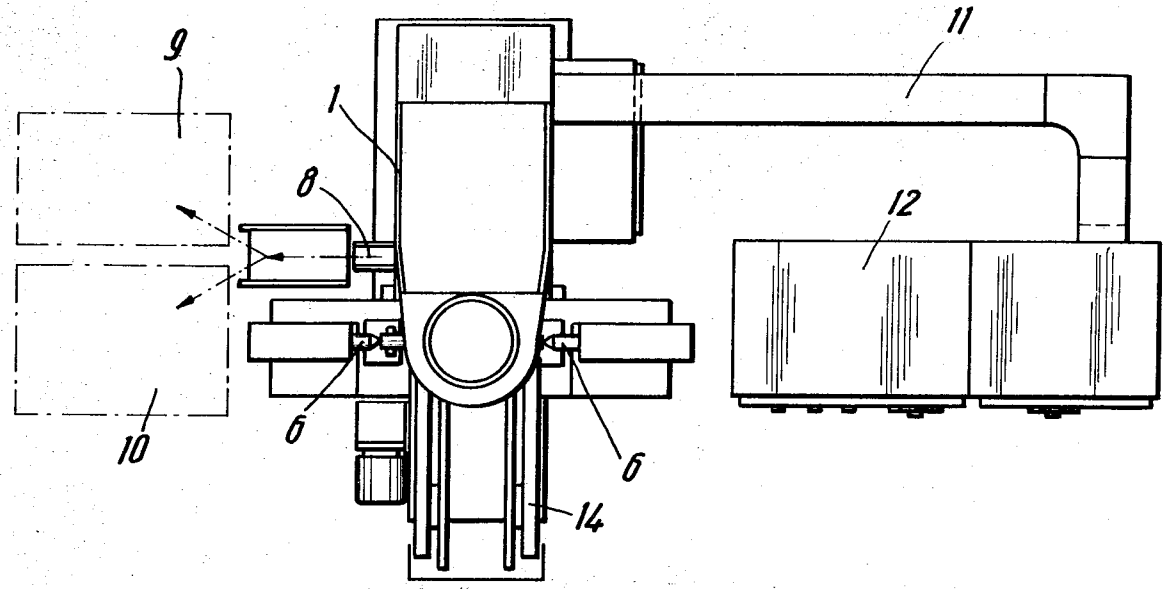
Figure 4:
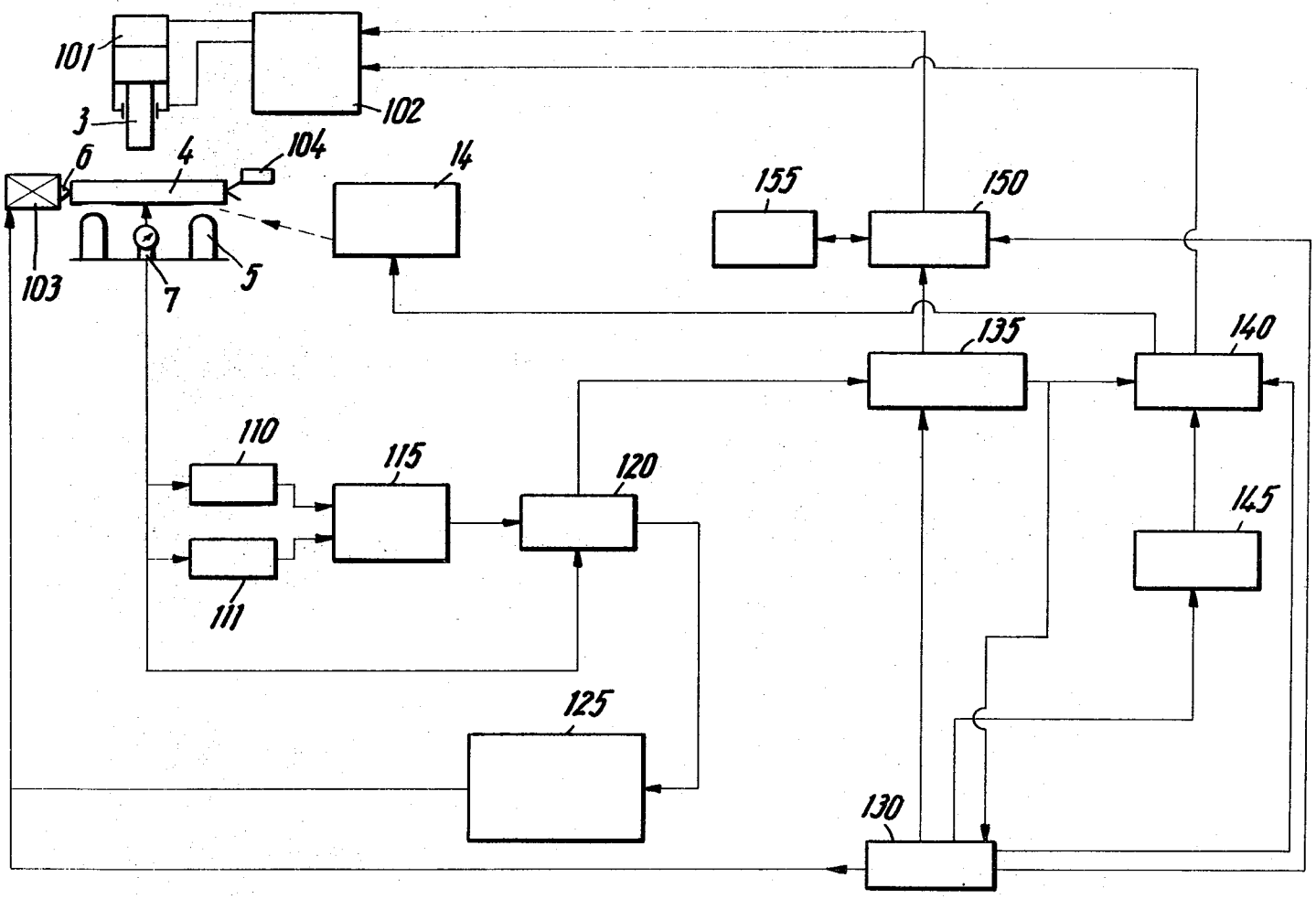

The invention is explained more fully with the aid of the drawing, in which:

FIGS. 1 to 3 are respectively a front view, a side view, and a plan view of one example of an automatic straightening press in accordance with the invention, and FIG. 4 is a block circuit diagram of an example of the control part of the automatic press.

The example illustrated has a C-shaped column 1, which has an aligning ram 2 with a straightening punch 3. The punch 3 can be brought hydraulically, by action of the aligning ram 2, into engagement with a workpiece 4. Workpiece 4, during the actual aligning operation, that is, during the operation of the straightening punch 3, rests on two straightening supports 5 and in addition lies between two workpiece holders in the form of centre sleeves or centre holders 6. The holders 6 are rotatable by means of a motor 103 (see FIG. 4) and can lift the workpiece 4 into a measuring position against a stop 104 (diagrammatically indicated in FIG. 4) by use of a lifting cylinder (not shown), while a measuring device 7 measures the deformation of the workpiece 4 as the latter is rotated by the centre sleeves 6.

A series of workpieces 4, 4', 4'' (see FIG. 2) are fed transversely to their axes by means of a step by step workpiece transport device 14 from a loading station. On completion of the straightening operation the workpieces are discharged longitudinally in relation to their axes from a delivery station by means of a chute 8. Preferably, predetermined straightening time is not to be exceeded. Any workpieces 4 which have not been completely straightened on the expiration of this straightening time are discharged into a container 9 for incompletely straightened workpieces; otherwise the straightened workpieces pass into a container 10 for properly straightened workpieces.

It can be seen that the feeding and discharge of the workpieces 4, 4', 4'' perpendicularly to their axes, instead of in the direction of their axes, entails only a very short loss of time for the exchange of workpieces, so that the automatic straightening press is particularly suitable for automated transfer lines with a short cycle time.

The automatic straightening press is particularly suitable for use with a production line. The process starts as soon as a workpiece is brought into the straightening station. It is advantageous for the straightening time to be restricted by means of an adjustable straightening time limiting unit 145 (see FIG. 4), in order to maintain a predetermined cycle time, since, through surface defects or non-circularity of individual workpieces, such as shafts, excessively long straightening times may arise. In the event of the straightening time being exceeded, this workpiece is separated or marked.

As here embodied, the press has a cable conduit 11, cabinet 12 connects the straightening press to a switch cabinet 12. Cabinet 12 contains the electronic control unit (see FIG. 4) of the straightening press.

The construction of the electronic control part is shown in simplified manner in FIG. 4, with the various parts clearly marked in the figure.

The straightening press works in the following manner:

The measuring device 7 is situated on the press bed under the straightening punch 3. A measuring lever 13 senses the workpiece 4 during its rotation by the motor 103 controlled by the control panel 130 and transmits the measurements to a measurement recorder (not separately shown) which is contained in the measuring device 7. The maximum value and the minimum value of the deformation are stored in stores 110 and 111 (see FIG. 4), and the arithmetic mean is calculated by addition followed by division by two in a mean value former 115 (see FIG. 4). This mean value is continuously compared in a first comparator 120 (see FIG. 4) with the instantaneous value of the deformation. As soon as this difference is zero and its sign changes from minus to plus, the motor 103 turns the centre sleeves 6 and consequently the workpiece 4 a further 90° under the command of an angular displacement transmitter 125 operated by the first comparator 120, so that the bend of the workpiece faces upwards towards the straightening punch 3. In this position the difference between the instantaneous value and the mean value of the deformation is determined in the first comparator 120 and then compared in a tolerance comparator 135 with a deformation tolerance fed in from the control panel 130. If the difference is greater than the deformation tolerance, a straightening operation is carried out. That is, the tolerance comparator 135 gives the appropriate order for the adjustment of the depth of stroke, in accordance with the measured difference, to an adjusting signal transmitter 150, to which, if desired, data regarding minimum stroke increase or stroke decrease can also be given from the control panel 130. The control signal transmitter 150 in turn controls an electrohydraulic drive 102 for the straightening cylinder 101.

The electrohydraulic drive 102 has an electric adjusting drive (not shown), which is operated directly by the adjusting signal transmitter 150 and in turn controls through a control member (not shown) a control slide valve (not shown) which adjusts the flow of pressure medium for the operation of ram 2 in cylinder 101. At the end of the straightening stroke the flow of pressure medium is interrupted by means of a switch stop moving in synchronism with the ram and consequently with punch 3. This switch stop returns the control slide valve to the starting position by way of the control member and thereby halts the punch 3. In this connection reference is made to the previously mentioned German Patent Specification No. 1,169,256. Although it shows a manually operated hydraulic aligning press, the reference nevertheless has a drive for the aligning ram which is substantially the same as the embodiment described here. However, the difference in that case is that the control member is adjusted by hand whereas in the present case the electric adjusting drive is provided and is operated by the adjusting signal transmitter 150.

After the straightening stroke has been made, the center sleeves 6 are again raised to the measuring position against the fixed stop 104, and the difference between the instantaneous value and the mean value of the deformation is again compared with the deformation tolerance in the tolerance comparator 135. If the deviation is still too great, the straightening punch 3 must make a deeper stroke. For this purpose the adjustment signal transmitter 150, with the aid of the electric adjusting drive, adjusts the control member of the control slide valve in the electrohydraulic drive 102 in such a manner that the switch stop of the straightening punch 3 reaches the control member somewhat later (see also the previously mentioned German Patent Specification No. 1,169,256). Thus the depth of stroke increases by an amount derived from the residual error and any adjustable minimum increase. This may take into account the geometrical shape of the workpiece.

Straightening and increase of stroke are repeated until the deformation is within the deformation tolerance. This depth of stroke, which may be less the adjustable decrease, is stored in a separate depth of stroke store 155 in order to ensure that the next identical workpiece will be straightened with this depth of stroke if it requires straightening.

After the tolerance comparator 135 has found that the measurement is correct or that a predetermined maximum straightening time fed into the straightening time limiting unit 145 from the control panel 130 has expired, an end of program is signalled by a workpiece change command transmitter 140 (which may also be operated direct from the control panel 130) which causes the ram 2 and consequently the punch 3 to travel a selectable distance upwards in order to permit the transport of the workpiece. This also operates the workpiece transport device 14 (indicated diagrammatically). At the same time the sleeves 6 fall and release the workpiece 4, so that the latter rests freely on the fixed supports 5 for further transport.

For transport purposes all the workpieces 4, 4', 4'' (see FIG. 2) are advanced one step by the workpiece transport device 14. If within the adjusted straightening time the workpiece has been straightened with the necessary accuracy, it passes into container 10, otherwise it passes into container 9.

The newly inserted identical workpiece is clamped, raised, etc., as previously described, but immediately undergoes a straightening operation with the stroke depth value last stored.

If the comparator 120 should detect overbending after any straightening stroke, that is, a negative sign of the difference between the new value and the instantaneous value of the deformation of the workpiece, this difference is nevertheless transmitted to the tolerance comparator 135. If the difference lies within the predetermined deformation tolerance, nothing is changed in the process described above. If however the value is greater than the deformation tolerance, the tolerance comparator 135 will on the one hand transmit through the control panel 130 a decrease signal to the adjusting signal transmitter 150, and on the other hand will restart the straightening process, that is, beginning with a full revolution of the workpiece and storing in the stores 110 and 111 the maximum and minimum value of the deformation thus measured.

We claim:

1. A process for automatically straightening elongated and at least partly rotationally symmetrical workpieces, including the application of a sequence of straightening strokes to a workpiece at one straightening station to counteract a deformation comprising the steps of:

a. rotating the workpiece through a full revolution;
b. detecting the maximum value and minimum value of deformation of said rotating workpiece;
c. determining the mean value of the maximum and minimum deformation detected;
d. again rotating the workpiece;
e. sensing the instantaneous values of deformation during rotation of the workpiece;
f. comparing the instantaneous values of deformation of the rotating workpiece with the mean value to detect a change of sign in the difference between said mean value and said sensed instantaneous values of deformation;
g. positioning the deformation of said workpiece towards an element applying the straightening stroke when said change of sign is detected;
h. comparing the instantaneous value of the positioned deformation to said mean value to determine whether a preset deformation tolerance is exceeded;
i. applying a straightening stroke if said sign is positive and said deformation tolerance is exceeded, the first straightening stroke of the sequence having a depth of stroke such that the straightening element is brought close to or touching the workpiece and a subsequent straightening stroke of the sequence having a depth of stroke increased from that of the previous straightening stroke by the latest measured difference between the instantaneous value of the positioned deformation and the mean value; and
j. repeating steps (h) and (i) until the deformation tolerance is not exceeded.

2. The process according to claim 1 further including, when the difference between the mean value and the instantaneous value of the deformation of the workpiece has a negative value and at the same time exceeds the preset deformation tolerance, after step (h) the steps of repositioning the workpiece for applying the straightening strokes to the deformation; decreasing the depth of stroke by an amount substantially equal to the preset deformation tolerance; and comparing the instantaneous value of the deformation of the repositioned workpiece with the mean value.

3. The process according to claim 1, wherein the first straightening stroke of the sequence in step (i) has a depth of stroke substantially equal to the distance between the element applying the straighening force when said element is in its starting position, and the center axis of the workpiece minus its radius.

4. The process according to claim 1, wherein at the second or a later straightening stroke of the sequence in step (i) the depth of stroke is subject to a minimum increase substantially equal to the preset deformation tolerance.

5. The process according to claim 1, wherein the steps of rotating and again rotating further includes the step of adjusting the rotational speed of the workpiece for the purpose of measuring the deformation.

6. The process according to claim 1, wherein, when a succession of workpieces to be straightened are identical, said first straightening stroke of the sequence in step (i) for any workpiece has a depth of stroke equal to the depth of stroke of the last straightening stroke performed on the immediately preceding straightened workpiece.

7. The process according to claim 6, wherein said first straightening stroke of the sequence in step (i) for the respective workpiece has a depth of stroke decreased by an amount substantially equal to the sum of the preset deformation tolerance and a predetermined tolerance of the diameter of the workpiece.

8. The process according to claim 1, further including after step (i) the steps of rotating the workpiece through a full revolution and comparing each instantaneous value of deformation of said rotating workpiece to said mean value to determine whether the preset deformation tolerance is exceeded.

9. The process according to claim 1 further including the step of sorting out or marking of a workpiece when a predetermined time or predetermined deformation has been exceeded.

10. The process according to claim 1 further including the steps of supplying to and discharging from said straightening station said workpiece transversely to its axial direction.

11. An automatic straightening press comprising a single straightening station for applying a sequence of straightening strokes to a workpiece to counteract a deformation, supports for receiving said workpiece, means for applying a straightening stroke to said workpiece, said means being automatically actuated for engagement with said workpiece, a drive element for providing an adjustable length of stroke to said applying means, a device for measuring deformation of said workpiece, means responsive to said sensing device for automatically actuating said drive element, a fixed stop for positioning said workpiece for measurement of the deformation, and holders for said workpiece, said holders being movable upwardly to bring said workpiece against said fixed stop, rotatable for measurement of said deformation, and movable downwardly to bring said workpiece onto said straightening supports for applying a straightening stroke.

12. An automatic straightening press according to claim 11 further comprising a measuring device for determining the distance between said means for applying the straightening stroke, in its initial position, and the workpiece.

* * * * *